United States Patent [19]

Imai et al.

[11] Patent Number: 5,039,971

[45] Date of Patent: Aug. 13, 1991

[54] VOLTAGE NON-LINEAR TYPE RESISTORS

[75] Inventors: Osamu Imai, Kasugai; Ritsu Sato, Iwakura, both of Japan

[73] Assignee: NGK Insulators, Ltd., Aichi, Japan

[21] Appl. No.: 389,301

[22] Filed: Aug. 3, 1989

[30] Foreign Application Priority Data

| | | | |
|---|---|---|---|
| Aug. 10, 1988 | [JP] | Japan | 63-197830 |
| Aug. 18, 1988 | [JP] | Japan | 63-203919 |
| Aug. 18, 1988 | [JP] | Japan | 63-203920 |

[51] Int. Cl.[5] ..... H01C 7/10

[52] U.S. Cl. ..... 338/21; 252/518; 338/20

[58] Field of Search ..... 338/20, 21; 252/518, 252/519, 520, 521

[56] References Cited

U.S. PATENT DOCUMENTS

| | | | |
|---|---|---|---|
| 4,362,656 | 12/1982 | Hormadaly | 338/308 |
| 4,527,146 | 7/1985 | Kanai et al. | 338/20 |
| 4,535,314 | 8/1985 | Kanai et al. | 338/21 |
| 4,724,416 | 2/1988 | Nakata et al. | 338/20 |
| 4,906,964 | 3/1990 | Imai et al. | 338/21 |

FOREIGN PATENT DOCUMENTS

| | | |
|---|---|---|
| 115149 | 8/1984 | European Pat. Off. . |
| 241150 | 10/1987 | European Pat. Off. . |
| 63-197830 | 1/1986 | Japan . |

OTHER PUBLICATIONS

M. Inada, "Formation Mechanism of Nonohmic Zinc Oxide Ceramics", Mar. 1980, Japanese Jornal of Applied Physics, vol. 19, No. 3, pp. 409–419.

E. Olsson et al., "The Microstructure of a ZnO Varistor Material", 11/1985, Journal of Materials Science, vol. 20, No. 11, pp. 4091–4098.

*Primary Examiner*—Marvin M. Lateef

*Attorney, Agent, or Firm*—Parkhurst, Wendel & Rossi

[57] ABSTRACT

A voltage non-linear resistor, composed mainly of zinc oxide and contains at least bismuth oxide, antimony oxide, and silicon oxide as additives, wherein crystalline phases of bismuth oxide includes at least two kinds of $\beta$ and $\delta$ satisfying the following inequalities:

$$60 \leqq \frac{\beta}{\beta + \delta} \times 100 \leqq 90$$

in which $\beta$ and $\delta$ are contents of the $\beta$ type crystalline phase and the $\delta$ type crystalline phase, respectively. A voltage non-linear resistor is also provided, wherein bismuth oxide further includes an $\alpha$ type crystalline phase, and $\alpha$, $\beta$ and $\delta$ satisfy the following inequalities:

$$15 \leqq \frac{\alpha}{\alpha + \beta + \delta} \times 100 \leqq 50,$$

$$25 \leqq \frac{\beta}{\alpha + \beta + \delta} \times 100 \leqq 60, \text{ and}$$

$$10 \leqq \frac{\delta}{\alpha + \beta + \delta} \times 100 \leqq 40,$$

in which $\alpha$ is a content of the $\alpha$ type crystalline phase. A voltage non-linear resistor is further provided, wherein the resistor contains at least $\delta$ type crystalline phase of bismuth oxide and an amorphous phase containing bismuth, and a content of bismuth in each of the phases satisfies the following inequalities:

$$0.10 \leqq B/A \leqq 0.40 \quad (1)$$

$$0.05 \leqq C/A \leqq 0.30 \quad (2)$$

in which A, B and C are the total content of bismuth in a sintered body of the resistor, the content of bismuth in the $\delta$ type crystalline phase of $Bi_2O_3$, and the content of bismuth in the bismuth-containing amorphous phase, respectively.

20 Claims, 1 Drawing Sheet

VOLTAGE NON-LINEAR TYPE RESISTORS

BACKGROUND OF THE INVENTION

1. Field of the Invention

The present invention relates to voltage nonlinear type resistors composed of zinc oxide as a main component.

2. Prior Art Technique

It is widely known that resistors composed mainly of zinc oxide and containing small amounts of additives such as $Bi_2O_3$, $Sb_2O_3$, $SiO_2$, $Co_2O_3$, and $MnO_2$ exhibit excellent voltage-current non-linearity. Such resistors are used for lightning arrestors or the like by utilizing their excellent property In particular, when the above resistor is used for a lightning arrestors and if excessive current is passed therethrough as a result of a thunderbolt, current is earthed through the voltage non-linear resistor which ordinarily functions as an insulator and which acts as a conductor when a voltage greater than a rated voltage is applied thereto. As a result, accidents due to the thunderbolt Falling can be prevented.

As crystalline phases of the voltage non-linear resistors, bismuth phases of an $\alpha$ type, a $\beta$ type, a $\gamma$ type and a $\delta$ type as well as a pyrochlore phase exist as intergranular layers in addition to a crystalline phase of zinc oxide. However, depending upon their contents or ratios, a change rate of $V_{1mA}$ after application of surge current increases or a change rate of a V-I characteristic increases with temperatures. In either case, the characteristic against repeated strikes of thunderbolts may be damaged. Further, when the $V_{1mA}$ change rate is great like this, there is damage of thermal runaway in the case of a gapless type lightning arrestor, and follow current cannot be interrupted in the case of a gap type lightning arrestor. Further, recent investigations have revealed that depending upon the contents or the ratios of the bismuth places of the $\alpha$, $\beta$, $\gamma$, and $\delta$ phases or the pyrochlore which exist as the intergranular phase besides the crystalline phase of zinc oxide mentioned above, variations in characteristics such as a voltage non-linearity index or a leakage current ratio becomes greater, and that hygroscopicity of the resistor is deteriorated.

SUMMARY OF THE INVENTION

It is an object of the present invention to overcome the above-mentioned problems, and to provide voltage non-linear resistors which exhibit good characteristics against repeated strikes of thunderbolts.

It is another object of the present invention to overcome the above-mentioned problems, and to provide volta9e non-linear resistors which have smaller variations and good hygroscopicity.

According to a first aspect of the present invention, a voltage non-linear resistor is provided, which is composed mainly of zinc oxide and contains metal oxides such as bismuth oxide, antimony oxide, and silicon oxide as additives, wherein crystalline phases of the bismuth oxide include at least two kinds of a $\beta$ type crystalline phase and a $\delta$ type crystalline phase, and $\beta$ and $\delta$ satisfy the following inequalities:

$$60 \leqq \frac{\beta}{\beta + \delta} \times 100 \leqq 90$$

in which $\beta$ and $\delta$ are contents of the $\beta$ type crystalline phase and the $\delta$ type crystalline phase, respectively.

According to a second aspect of the present invention, a voltage non-linear resistor is provided, which is composed mainly of zinc oxide and contains metal oxides such as bismuth oxide, antimony oxide, and silicon oxide as additives, wherein crystalline phases of the bismuth oxide include at least three kinds of an $\alpha$ type crystalline phase, a $\beta$ type crystalline phase, and a $\alpha$ type crystalline phase, and $\delta$, $\alpha$ and $\beta$ satisfy the following inequalities:

$$15 \leqq \frac{\alpha}{\alpha + \beta + \delta} \times 100 \leqq 50,$$

$$25 \leqq \frac{\beta}{\alpha + \beta + \delta} \times 100 \leqq 60, \text{ and}$$

$$10 \leqq \frac{\delta}{\alpha + \beta + \delta} \times 100 \leqq 40,$$

In which, $\alpha$, $\beta$ and $\delta$ are contents of the $\alpha$ type crystalline phase, the $\beta$ type crystalline phase, and the $\delta$ type crystalline phase, respectively.

According to a third aspect of the present invention, a voltage non-linear resistor is provided, which is composed mainly of zinc oxide and contains metal oxides such as bismuth oxide, antimony oxide, and silicon oxide as additives, wherein the resistor contains at least a $\delta$-$Bi_2O_3$ crystalline phase and an amorphous phase containing bismuth, and a content of bismuth in each of the phases satisfies the following inequalities:

$$0.10 \leqq B/A \leqq 0.40 \quad (1)$$

$$0.05 \leqq C/A \leqq 0.30 \quad (2)$$

in which A, B and C are the total content of bismuth in a sintered body of the resistor, the content of bismuth in the $\delta$-$Bi_2O_3$ type crystalline phase, and the content of bismuth in the bismuth-containing amorphous phase, respectively.

The first aspect of the present invention has been accomplished based on the discovery that the voltage non-linear resistor of which the crystalline phase contains at least the $\beta$ type crystalline phase and the $\delta$ type crystalline phase in the specified ratio range has a small change rate of $V_{1mA}$ after application of surge and small change in the V-I Characteristic with temperature, as is clear from experiments mentioned later. As a result, the voltage non-linear resistor having good surge-withstanding capability, good characteristics against repeated strikes of thunderbolts, and good use life while being free from thermal runaway can be obtained.

Turning now to the effects obtained by each of the phases, the $\delta$ type crystalline phase mainly functions to decrease the $V_{1mA}$ change rate after application of thunderbolt surges. It also functions to improve the surge-withstanding capability. The $\beta$ type crystalline phase mainly functions to decrease the change ratio of the V-I characteristic with temperature, and its function is further improved under coexistence with the $\delta$ type crystalline phase. Only the $\beta$ type crystalline phase unfavorably deteriorates the use life. Although a $\gamma$ type crystalline phase improves use life, it adversely affects other characteristics mentioned above. Thus, the $\gamma$ type crystalline phase is preferably not more than 0.5 wt% at the maximum. It is preferable that no pyrochlore phase is contained.

In addition, 0.01 to 0.3 wt% of a glass frit is added in the production of the resistor. Further, it is preferable to add silicon oxide in the state of an amorphous phase, because an intergranular phase is stabilized therewith.

It is preferable that $70 \leqq \beta/(\beta+\delta) \times 100 \leqq 80$, because the effects attainable in the present invention becomes more conspicuous.

The second aspect of the present invention has been accomplished based on the discovery that the voltage non-linear resistor in which the crystalline phases of the bismuth oxide in the resistor include at least the $\alpha$ type crystalline phase, the $\beta$ type crystalline phase, and the $\delta$ type crystalline phase has small change rate of $V_{1mA}$ after application of Surge and small change rate of V-I characteristic with temperature, as is clear from experiments mentioned later. As a result, the voltage non-linear resistor which has good surge-withstanding capability, good resistance against repeated fallings of thunderbolts and long use life while being free from thermal runaway can be obtained.

Turning now to effects of the phases, the $\delta$ phase mainly functions to decrease the $V_{1mA}$ change rate, and also functions to improve the surge-withstanding capability. The $\alpha$ and $\beta$ phases mainly have an effect to decrease the change rate of the V-I characteristic with temperatures. If the $\alpha$ phase or the $\beta$ phase singly exists, the above effect is small, and the use life is shortened. If the $\alpha$ phase and the $\beta$ phase fall outside the range in the present invention, the effect is small. Furthermore, although the $\gamma$ phase prolongs the use life, the phase adversely affects the other characteristics mentioned later. Thus, the $\gamma$ phase is preferably not more than 0.5 wt% at the maximum. Further, it is preferable that no pyrochlore phase is contained.

In producing the resistor, 0.01 to 0.03 wt% of glass frit is preferably added. In addition, silicon oxide is preferably added in the state of an amorphous phase, because the intergranular phase is stabilized.

It is preferable that the contents of the $\alpha$, $\beta$ and $\delta$ crystalline phases satisfy the following inequalities, because the effects of the invention become more conspicuous.

$$25 \leqq \frac{\alpha}{\alpha+\beta+\delta} \times 100 \leqq 40,$$

$$40 \leqq \frac{\beta}{\alpha+\beta+\delta} \times 100 \leqq 50, \text{ and}$$

$$20 \leqq \frac{\delta}{\alpha+\beta+\delta} \times 100 \leqq 30,$$

The third aspect of the present invention has been accomplished based on the discovery that the voltage non-linear resistor in which the intergranular phase is partially made amorphous by the incorporation of bismuth into the sintered body and the content of bismuth in the amorphous phase and that in the $\delta$-$Bi_2O_3$ phase are controlled to the respectively specified ranges has small variations in the characteristics such as voltage non-linearity index, the change rate of $V_{1mA}$ after application of thunderbolt surge, limit voltage ratio, and leakage current ratio as well as good hygroscopicity of the non-linear resistor, as mentioned later in Experiments.

As mentioned later, the voltage non-linear resistor can appropriately be obtained by selectively combining the kinds of and addition amounts of raw materials, final firing conditions, cooling rate and thermally treating conditions after the final firing.

Use of glass frit containing silver or boron in the raw material is preferable, because the frit improves characteristics of the resistor. Boron advances the diffusion of additive components, and promotes the uniformization of the characteristics over the sintered body, and the glass frit stabilizes the intergranular phase. Silver suppresses movement of ions due to charging, and stabilizes the intergranular phase. As an example, borosilicate bismuth glass containing silver is preferably added. It is preferable that the addition amount of the glass frit is 0.01 to 0.3 wt%, the contents of $Ag_2O$ and $B_2O_3$ in the glass frit being both 10 to 30 wt%. Further, it is preferable that pyrochlore which is conventionally confirmed in the intergranular phase is not contained.

These and other objects, features, and advantages of the invention will be appreciated upon reading of the following description of the invention when taken in conjunction with the attached drawing, with the understanding that some modifications, variations, and changes of the same could be made by the skilled person in the art to which the invention pertains without departing from the spirit of the invention or the scope of claims appended hereto.

BRIEF DESCRIPTION OF THE ATTACHED DRAWING

For a better understanding of the invention, reference is made to the drawing, wherein:

FIG. 1 is a diagram showing a charging pattern with respect to the relationship between the leakage current and time.

DETAILED DESCRIPTION OF THE INVENTION

Figure 1:
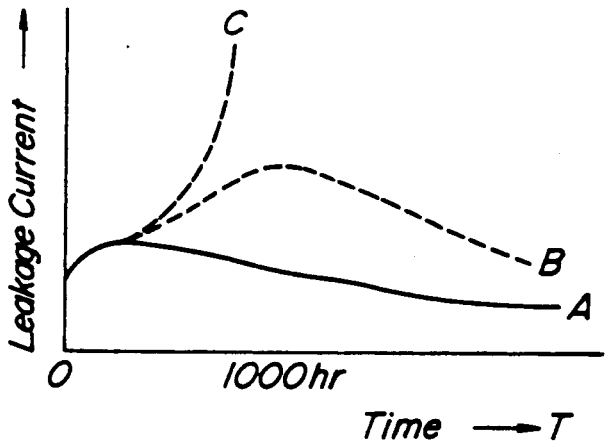

In order to obtain a voltage non-linear resistor composed mainly of zinc oxide, additives such as bismuth oxide, cobalt oxide, manganese oxide, antimony oxide, chromium oxide, preferably amorphous silicon oxide, nickel oxide, boron oxide, and silver oxide are mixed with a zinc oxide raw material in given mixing amounts. All of the additives and the raw material are adjusted to respectively given particle sizes. In this case, silver nitrate and boric acid may be used instead of silver oxide and boron oxide, respectively. Preferably, bismuth borosilicate containing silver is used. In such a use, a given amount of an aqueous solution of polyvinyl alcohol is added to the powders of these materials. Preferably, a given amount of a solution of aluminum nitrate is added as a source of aluminum oxide. The mixing is effected by using an emulsifying machine.

Next, a mixed slip is obtained by deairing in vacuum under a reduced pressure of preferably 200 mmHg or less. It is preferable that the content of water and the viscosity of the mixed slip are 30 to 35 wt% and $100 \pm 50$ cp, respectively. Then, the thus obtained mixed slip is fed to a spray drier to produce granulated powder having an average particle diameter of 50 to 150 μm, preferably 80 to 120 μm, and the water content of 0.5 to 2.0 wt%, preferably 0.9 to 1.5 wt%. Next, the granulated powder obtained is shaped in a desired shape under a shaping pressure of 800 to 1,000 kg/cm$^2$ in a shaping step. Thereafter, the shaped body is fired under conditions that heating and cooling are effected at a rate of 50° to 70° C./hr (heating rate and cooling rate) in a temperature range from 800° to 1,000° C. and the shaped body is held at 1,000° C. for 1 to 5 hours (a keeping time of 1 to 5 hours). It is preferable that a binder contained is removed off by heating and cooling the shaped body at a rate of 10° to 100° C. in a temperature range from 400° to 600° C. while holding it at 600° C. for a keeping time of 1 to 10 hours before calcination.

Next, an insulating covering layer is formed on the side surface of a calcined body. In the present invention, an oxide paste in which ethyl cellulose, butyl carbitol, or n-butyl acetate is added, as an organic binder, to given amounts of $Bi_2O_3$, $Sb_2O_3$, ZnO, and/or $SiO_2$ is coated onto the side surface of the calcined body in a coated thickness of 60 to 300 μm. Next, the coated body is fired under conditions that the coated body is finally fired at a heating and cooling rate of 20° to 60° C./hr in a temperature range from 1,000° to 1,300° C., preferably 1,100° to 1,250° C., while being kept at the maximum temperature for 3 to 7 hours. A glass paste in which ethyl cellulose, butyl carbitol or n-butyl acetate added, as an organic binder, to a glass powder is coated onto the insulating covering layer in a thickness of 100 to 300 μm, which is thermally treated at a heating and cooling rate of 50° to 200° C./hr in a temperature range from 400° to 900° C. while being kept at 900° C. for a keeping time of 0.5 to 2 hours to form a glass layer.

Thereafter, opposite end faces of the thus obtained voltage non-linear resistor are polished with an abrasive #400 to 2000, such as SiC, $Al_2O_3$ or diamond powder by using water or oil as a polishing liquid. Next, after the polished surfaces are washed, a metalicon electrode is formed on each of the polished opposite surfaces with an aluminum metalicon, for instance, by metallizing, thereby obtaining a voltage non-linear resistor.

The crystalline phases of bismuth oxide have the following characteristics.

A great amount of the α phase is produced when the addition amount of amorphous $SiO_2$ is small and the cooling rate in the final firing is low. With respect to the β phase, a great amount of it is produced when the addition amount of amorphous $SiO_2$ is small and the cooling rate in the final firing is great. The γ phase is produced by thermal treatment after the final firing, and particularly the production thereof is conspicuous when the thermal treatment is effected at 600° to 800° C. With respect to the δ phase, a great amount of it is produced when the addition amount of amorphous $SiO_2$ is great and the cooling rate in the final firing is relatively small.

According to the present invention, the contents of the crystalline phases of bismuth oxides are controlled mainly based on the above criteria.

In the above-mentioned producing process, the voltage non-linear resistor according to the present invention, which include at least the β-$Bi_2O_3$ crystalline phase and the δ-$Bi_2O_3$ crystalline phase in the specified ratio range, or which includes the α-$Bi_2O_3$ crystalline phase, the β-$Bi_2O_3$ crystalline phase, and the δ-$Bi_2O_3$ crystalline phase in the specified ratio range in the sintered body, or which includes the δ-$Bi_2O_3$ crystalline phase and the amorphous phase containing bismuth in the intergranular layer of the sintered body in the specified ratio range, can be obtained by variously combining the kinds of the raw materials, the addition amounts, the final firing conditions, the cooling rate in the final firing, the thermal treatment conditions after the final firing, and the like. Thus, the voltage non-linear resistor having the good $V_{1mA}$ change rate, the change rate of the V-I characteristic against temperatures, and/or the voltage non-linearity can be obtained.

In the following, with respect to voltage non-linear resistors falling inside or outside the scope of the present invention, various characteristics were actually measured, and results thereof will be explained.

(EXAMPLES)

Experiment 1

According to the above-mentioned method, sample Nos. 1-1 through 1-7 according to the present invention and Comparative sample Nos. 1-1 through 1-3 were prepared from a raw material consisting of 0.1 to 2.0 mol% of $Bi_2O_3$, $Co_3O_4$, $MnO_2$, $Sb_2O_3$, and $Cr_2O_3$, 0.001 to 0.01 mol% of $Al(NO_3)_3.9H_2O$, 0.01 to 0.3 wt% of a bismuth borosilicate glass containing silver, 0.5 to 3.0 mol% of amorphous $SiO_2$, and the balance being ZnO. Each of the samples had a diameter of 47 mm and a thickness of 22.5 mm, and a crystalline phase shown in Table 1.

With respect to the resistors thus prepared according to the invention samples and Comparative samples, temperature characteristic, $V_{1mA}$ reduction rate, thunderbolt surge-withstanding capability, and on-off surge-withstanding capability were measured, and charge use life pattern was determined. Results are shown in Table 1. In this experiment, the temperature characteristic was determined as change rates of $V_{1mA}$ and $V_{40kA}$ at 150° C. relative to those at 25° C., respectively. As compared with $V_{1mA}$ and $V_{40kA}$ at 25° C., the $V_{1mA}$ lowers and the $V_{40kA}$ increases at 150° C. The reduction rate of $V_{1mA}$ was determined by values of $V_{1mA}$ before and after applications of electric current of 30 kA in the form of 8/20 μs electric current waves ten times. As to the thunderbolt-withstanding capability, those which were broken and not broken upon application of electric currents of 130 kA and 150 kA in the form of electric current waves of 4/10 μs twice are shown by X and O, respectively. With respect to the on-off surge-withstanding capability, those which were broken and not broken upon applications of electric current of 800 A and 1,000 A in the form of electric current of 2 ms twenty times are shown by X and O, respectively. Further, the charge pattern was determined based on the relationship between the current and time in FIG. 1. In FIG. 1, A, B, C denote most excellent samples, good samples which were restored without being thermally runaway, and those which were thermally runaway, respectively. The amount of each of the crystalline phases was determined by an internal standard method in X-ray diffraction.

TABLE 1

| Sample No. | Final firing Cooling rate (°C./hr) | Addition amount of amorphous $SiO_2$ | Thermally treating conditions: Temperature (°C.) | Thermally treating conditions: Cooling rate (°C./hr) | Ratio of crystalline phases (%): β phase | Ratio of crystalline phases (%): δ phase | Other crystalline phase | Temperature characteristic: $V_{1mA}$ change rate (%) | Temperature characteristic: $V_{40kA}$ change rate (%) |
|---|---|---|---|---|---|---|---|---|---|
| Example | | | | | | | | | |

TABLE 1-continued

| | | | | | | | | | |
|---|---|---|---|---|---|---|---|---|---|
| 1-1 | 30 | 0.5 | — | — | 60 | 40 | α | 4.8 | 3.3 |
| 1-2 | 30 | 3.0 | 500 | 60 | 64 | 36 | γ | 4.2 | 3.2 |
| 1-3 | 30 | 1.0 | — | — | 71 | 29 | | 3.9 | 2.9 |
| 1-4 | 50 | 0.5 | — | — | 76 | 24 | α | 4.0 | 3.1 |
| 1-5 | 50 | 1.0 | — | — | 80 | 20 | | 3.8 | 2.8 |
| 1-6 | 50 | 3.0 | 500 | 60 | 86 | 14 | γ | 4.6 | 3.8 |
| 1-7 | 60 | 1.0 | — | — | 90 | 10 | | 5.5 | 3.7 |
| Comparative Example | | | | | | | | | |
| 1-1 | 5 | 1.0 | — | — | 49 | 51 | | 6.5 | 4.9 |
| 1-2 | 200 | 1.0 | — | — | 100 | 0 | | 6.5 | 4.2 |
| 1-3 | 50 | 1.0 | 750 | 100 | 0 | 0 | γ | 22.0 | 6.0 |

| | $V_{1mA}$ reduction rate (%) | | Thunderbolt surge-withstanding capability | | Switching surge-withstanding capability | | Life pattern of charging |
|---|---|---|---|---|---|---|---|
| Sample No. | Average | $\sigma_{n-1}$ | 130 kA | 150 kA | 800 A | 1000 A | |
| Example | | | | | | | |
| 1-1 | 5.5 | 1.0 | O | O | O | O | B |
| 1-2 | 4.6 | 0.8 | O | O | O | X | B |
| 1-3 | 3.0 | 0.6 | O | O | O | O | B |
| 1-4 | 3.1 | 0.7 | O | O | O | O | B |
| 1-5 | 3.5 | 0.5 | O | O | O | O | B |
| 1-6 | 4.4 | 0.8 | O | X | O | O | B |
| 1-7 | 5.7 | 0.9 | O | X | O | O | B |
| Comparative Example | | | | | | | |
| 1-1 | 9.9 | 1.9 | O | X | O | X | C |
| 1-2 | 13.2 | 2.7 | X | — | X | — | C |
| 1-3 | 15.3 | 2.8 | X | — | X | — | A |

Final firing was effected at 1,200° C. for 5 hours for all the samples (heating rate: 40° C./hr)

It is clear from the results in Table 1 that the resistors containing at least the β phase and the δ phase at the specific ratio according to the present invention have better temperature characteristic and $V_{1mA}$ reduction rate as compared with Comparative Examples in addition to the other characteristics.

Although the change life pattern is not of an A type (see FIG. 1) in the present invention, there is no fear of thermal runaway. In the case of the gap-provided type lightning arrestors, there is no problem even for a B type because the element is always charged.

As understood from the above explanation, since the voltage non-linear resistor according to the present invention contains at least the β phase and the δ phase at the specific ratio, the change rate of $V_{1mA}$ due to application of thunderbolt surge is small and change in the voltage-current characteristic relative to the temperature change is small. Thus, good resistance against repeated thunderbolts as well as good surge-withstanding capability, use life, and other characteristics can be obtained.

Experiment 2

According to the above-mentioned method, sample Nos. 2-1 through 2-9 according to the present invention and Comparative sample Nos. 2-1 through 2-10 were prepared from a raw material consisting of 0.1 to 2.0 mol% of each of $Bi_2O_3$, $Co_3O_4$, $MnO_2$, $Sb_2O_3$, $Cr_2O_3$ and NiO, 0.001 to 0.01 mol% of $Al(NO_3)_3.9H_2O$, 0.01 to 0.3 wt% of a bismuth borosilicate glass containing silver, 1.0 to 3.0 mol% of amorphous $SiO_2$, and the balance being ZnO. Each of the samples had a diameter of 47 mm and a thickness of 22.5 mm, a crystalline phase shown in Table 1, and a varistor voltage ($V_{1mA}$) of 200 to 230 V/mm.

With respect to resistors thus prepared as the invention samples and Comparative samples, temperature characteristic, $V_{1mA}$ reduction rate, thunderbolt surge-withstanding capability, and switching surge-withstanding capability were measured, and charge use life pattern was determined. Results are shown in Table 2. In this experiment, the temperature characteristic was determined as change rates of $V_{1mA}$ and $V_{40kA}$ at 150° C. relative to those at 25° C., respectively. As compared with $V_{1mA}$ and $V_{40kA}$ at 25° C., $V_{1mA}$ lowers and $V_{40kA}$ increases at 150° C. The reduction rate of $V_{1mA}$ was determined by values of $V_{1mA}$ before and after applications of electric current of 30 kA in the form of 8/20 μs electric current waves ten times. As to the thunderbolt-withstanding capability, those which were broken and not broken upon application of electric current of 130 kA and 150 kA in the form of electric current waves of 4/10 μs twice are shown by X and O, respectively. With respect to the switching surge-withstanding capability, those which were broken and not broken upon application of electric current of 800 A and 1,000 A in the form of electric current waves of 2 ms twenty times are shown by X and O, respectively. Further, the charge pattern was determined based on the relationship between the leakage current and time in FIG. 1. In FIG. 1, A, B, C denote most excellent samples, good samples which were restored without being thermally runaway, and those which were thermally runaway, respectively. The amount of each of the crystalline phases was determined by an internal standard method in X-ray diffraction.

TABLE 2

| | Final | Addition | Thermally treating | Temperature characteristic |
|---|---|---|---|---|

TABLE 2-continued

| Sample No. | firing Cooling rate (°C./hr) | amount of amorphous $SiO_2$ | conditions Temperature (°C.) | conditions Cooling rate (°C./hr) | Ratio of crystalline phases (%) α phase | β phase | δ phase | Other crystalline phase | $V_{1mA}$ change rate (%) | $V_{40kA}$ change rate (%) |
|---|---|---|---|---|---|---|---|---|---|---|
| Example | | | | | | | | | | |
| 2-1 | 50 | 3.0 | — | — | 17 | 48 | 35 | — | 5.2 | 3.2 |
| 2-2 | 20 | 3.0 | 500 | 60 | 43 | 27 | 30 | γ0.5 | 5.9 | 2.1 |
| 2-3 | 60 | 1.0 | — | — | 34 | 55 | 11 | — | 5.1 | 2.0 |
| 2-4 | 30 | 1.0 | — | — | 48 | 33 | 19 | — | 4.9 | 3.1 |
| 2-5 | 60 | 1.5 | 500 | 60 | 25 | 60 | 15 | γ0.5 | 6.2 | 2.5 |
| 2-6 | 60 | 3.0 | — | — | 19 | 42 | 39 | — | 5.5 | 2.4 |
| 2-7 | 50 | 2.0 | — | — | 28 | 49 | 23 | — | 4.0 | 2.9 |
| 2-8 | 40 | 1.5 | — | — | 39 | 40 | 21 | — | 4.5 | 2.1 |
| 2-9 | 40 | 2.0 | — | — | 31 | 39 | 30 | — | 3.9 | 3.5 |
| Comparative Example | | | | | | | | | | |
| 2-1 | 80 | 4.0 | — | — | 11 | 59 | 30 | — | 8.3 | 4.3 |
| 2-2 | 20 | 1.0 | — | — | 48 | 20 | 32 | — | 8.1 | 3.9 |
| 2-3 | 60 | 0.5 | — | — | 41 | 53 | 6 | — | 7.3 | 4.2 |
| 2-4 | 20 | 0.5 | — | — | 58 | 25 | 17 | — | 7.7 | 4.7 |
| 2-5 | 100 | 3.0 | — | — | 20 | 68 | 12 | — | 7.6 | 3.3 |
| 2-6 | 20 | 3.0 | — | — | 21 | 31 | 48 | — | 8.8 | 5.1 |
| 2-7 | 70 | 0.1 | — | — | 43 | 57 | — | — | 10.1 | 4.2 |
| 2-8 | 60 | 4.0 | — | — | — | 60 | 40 | — | 11.3 | 5.9 |
| 2-9 | 15 | 1.5 | 550 | 60 | 35 | — | 65 | γ55 | 16.8 | 5.8 |
| 2-10 | 40 | 1.5 | 750 | 100 | — | — | — | γ100 | 21.0 | 6.1 |

| Sample No. | $V_{1mA}$ reduction rate (%) Average | $\sigma_{n-1}$ | Thunderbolt surge-withstanding capability 130 kA | 150 kA | Switching surge-withstanding capability 800 A | 1000 A | Life pattern or charging |
|---|---|---|---|---|---|---|---|
| Example | | | | | | | |
| 2-1 | 3.2 | 1.0 | O | O | O | X | B |
| 2-2 | 3.2 | 0.9 | O | X | O | X | B |
| 2-3 | 4.1 | 0.6 | O | O | O | X | B |
| 2-4 | 4.9 | 0.7 | O | X | O | O | B |
| 2-5 | 4.8 | 1.0 | O | X | O | X | B |
| 2-6 | 4.4 | 0.8 | O | O | O | X | B |
| 2-7 | 3.9 | 0.5 | O | O | O | O | B |
| 2-8 | 3.7 | 0.6 | O | O | O | O | B |
| 2-9 | 3.5 | 0.5 | O | O | O | O | B |
| Comparative Example | | | | | | | |
| 2-1 | 6.2 | 2.0 | O | X | X | — | B |
| 2-2 | 6.7 | 2.2 | O | X | X | — | B |
| 2-3 | 7.8 | 2.4 | X | — | X | — | C |
| 2-4 | 6.5 | 2.3 | X | — | O | X | B |
| 2-5 | 7.1 | 2.0 | X | — | X | — | B |
| 2-6 | 6.4 | 1.9 | O | X | X | — | C |
| 2-7 | 8.0 | 2.4 | X | — | X | — | C |
| 2-8 | 7.5 | 2.5 | X | — | O | X | C |
| 2-9 | 8.9 | 2.5 | O | X | X | — | B |
| 2-10 | 9.2 | 2.9 | X | — | X | — | A |

Final firing was effected at 1,200° C. for 5 hours for all the samples (heating rate: 40° C./hr)

From the results in Table 2, it is seen that the resistors according to the present invention containing at least the α phase, the β phase and the δ phase have better temperature characteristic, $V_{1mA}$ reduction rate, and other characteristics as compared with Comparative Examples.

Although the life pattern on charging of the resistors according to the present invention are not of the A type (best), there is no fear of thermal runaway. Since a gap-provided type lightning arrestor is always charged, no problem occurs even when it is of the B type.

As understood from the above explanation, since the voltage non-linear resistor according to the second aspect of the present invention contains at least the α phase, the β phase and the δ phase at the specific ratios, small change rate of $V_{1mA}$ due to application of thunderbolt surge, small voltage-current characteristic relative to the temperature change, and good resistance against repeated application of surges can be obtained. Thus, good resistance against repeated thunderbolt as well as good surge-withstanding capability, use life, and other characteristics can be obtained.

Experiment 3

According to the above-mentioned method, sample Nos. 3-1 through 3-8 according to the present invention and Comparative sample Nos. 3-1 through 3-8 were prepared from a raw material consisting of 0.1 to 2.0 mol% of each of $Bi_2O_3$, $Co_3O_4$, $MnO_2$, $Sb_2O_3$, $Cr_2O_3$ and NiO, 0.001 to 0.01 mol% of $Al(NO_3)_3.9H_2O$, 0.01 to 0.3 wt% of bismuth borosilicate glass containing silver, 1.0 to 3.0 mol% of amorphous $SiO_2$, and the balance being ZnO. Each of the samples had a diameter of 47 mm and a thickness of 20 mm, and a varistor voltage ($V_{1mA}$) of 200 to 230 V/mm.

With respect to resistors thus prepared as the invention samples and Comparative samples, voltage non-linear index, $V_{1mA}$ reduction rate due to application of thunderbolt surge, limit voltage ratio, and leakage current ratio were measured, and hygroscopicity of elements was examined. Results are shown in Table 3. In this experiment, the voltage non-linearity index $\alpha$ was determined from the ratio between $V_{1mA}$ and $V_{100\mu A}$ according to $I=KV^{\alpha}$ in which I, V, and K are current, voltage, and a proportional constant, respectively. The reduction rate of $V_{1mA}$ due to application of thunderbolt surge was determined by values of $V_{1mA}$ before and after applications of electric current of 40 kA in the form of 4/10 μs electric current waves ten times. The limit voltage ratio was determined from the ratio between applied voltage and the varistor voltage necessary for flowing current of 10 kA in the form of 8/20 ms current waveform. The rate of the leakage current was determined from the current ratio of $I_{100}$ hour/$I_0$ hour with lapse of 100 hour charging immediately after the charging when the element was charged at the charging rate of 95% at a surrounding temperature of 130° C. Further, the amounts of the crystalline phases and the ratios thereof were determined based on the internal standard method in the X-ray diffraction. Furthermore, hygroscopicity was determined by a 24 hour immersing process in a fluorescent beam scratch-detecting liquid under application of 200 kg/cm². In Table 3, samples which underwent impregnation and those which did not undergo impregnation are shown by X and O, respectively.

TABLE 3

| Sample No. | Final firing Cooling rate (°C./hr) | Addition amount of amorphous $SiO_2$ | Thermally treating conditions: Temperature (°C.) | Thermally treating conditions: Cooling rate (°C/hr) | B/A | C/A | Other crystalline phase | Voltage non-linearity index: Average | Voltage non-linearity index: $\sigma_{n-1}$ |
|---|---|---|---|---|---|---|---|---|---|
| Example | | | | | | | | | |
| 3-1 | 60 | 1.0 | 900 | 200 | 0.13 | 0.28 | α, β | 45 | 3.3 |
| 3-2 | 20 | 3.0 | 800 | 100 | 0.40 | 0.07 | α | 51 | 3.8 |
| 3-3 | 40 | 2.0 | 850 | 180 | 0.22 | 0.19 | γ | 31 | 2.4 |
| 3-4 | 50 | 2.0 | 800 | 150 | 0.29 | 0.10 | α | 39 | 2.2 |
| 3-5 | 30 | 1.5 | 800 | 180 | 0.27 | 0.14 | α, β | 48 | 2.1 |
| 3-6 | 50 | 1.0 | 800 | 200 | 0.25 | 0.18 | α, β, γ | 40 | 2.0 |
| 3-7 | 30 | 3.0 | 850 | 200 | 0.38 | 0.24 | α, γ | 39 | 3.5 |
| 3-8 | 60 | 2.0 | 900 | 200 | 0.22 | 0.30 | β | 70 | 3.2 |
| Comparative Example | | | | | | | | | |
| 3-1 | 40 | 0.5 | — | — | 0.23 | 0 | α | 62 | 4.5 |
| 3-2 | 60 | 1.0 | 1000 | 250 | 0.20 | 0.41 | β, γ | 33 | 4.2 |
| 3-3 | 20 | 0.5 | 800 | 100 | 0 | 0.09 | α | 55 | 3.9 |
| 3-4 | 60 | 0.5 | 800 | 150 | 0 | 0.11 | β, γ | 39 | 4.1 |
| 3-5 | 40 | 1.0 | 800 | 200 | 0 | 0.13 | γ | 25 | 4.9 |
| 3-6 | 40 | 5.0 | 850 | 200 | 0.49 | 0.20 | α, β | 41 | 4.5 |
| 3-7 | 40 | 2.0 | 750 | 100 | 0 | 0 | γ | 33 | 3.8 |
| 3-8 | 40 | 6.0 | 1000 | 250 | 0.52 | 0.45 | α, β | 45 | 4.4 |

| Sample No. | $V_{1mA}$ reduction rate (%): Average | $V_{1mA}$ reduction rate (%): $\sigma_{n-1}$ | Limit voltage ratio $V_{10kA}/V_{1mA}$ | Rate of leakage current: Average | Rate of leakage current: $\sigma_{n-1}$ | Hygroscopicity |
|---|---|---|---|---|---|---|
| Example | | | | | | |
| 3-1 | 5.5 | 1.0 | 1.7 | 0.68 | 0.11 | O |
| 3-2 | 5.6 | 0.9 | 1.6 | 0.69 | 0.10 | O |
| 3-3 | 3.8 | 0.4 | 1.6 | 0.29 | 0.05 | O |
| 3-4 | 4.2 | 0.5 | 1.6 | 0.61 | 0.09 | O |
| 3-5 | 4.3 | 0.5 | 1.6 | 0.60 | 0.08 | O |
| 3-6 | 4.0 | 0.6 | 1.6 | 0.31 | 0.10 | O |
| 3-7 | 5.8 | 0.9 | 1.7 | 0.35 | 0.08 | O |
| 3-8 | 5.2 | 1.2 | 1.6 | 0.59 | 0.10 | O |
| Comparative Example | | | | | | |
| 3-1 | 8.8 | 2.9 | 1.9 | 1.02 | 0.40 | X |
| 3-2 | 9.9 | 3.1 | 2.0 | 0.49 | 0.39 | X |
| 3-3 | 7.7 | 1.8 | 1.9 | 0.78 | 0.38 | O |
| 3-4 | 8.1 | 2.5 | 1.8 | 0.35 | 0.22 | X |
| 3-5 | 7.4 | 2.3 | 1.9 | 0.35 | 0.18 | O |
| 3-6 | 7.3 | 2.9 | 1.8 | 0.82 | 0.30 | O |
| 3-7 | 7.5 | 2.5 | 1.9 | 0.41 | 0.25 | X |
| 3-8 | 9.8 | 3.2 | 1.8 | 0.55 | 0.45 | X |

Final firing was effected at 1,200° C. for 5 hours for all the samples (heating rate: 40° C./hr)
Remarks:
A: Total content of bismuth in sintered body
B: Content of bismuth in δ-$Bi_2O_3$ crystalline phase
C: Content of bismuth in Bi-containing amorphouse phase From the above, it is seen that Sample Nos. 3-1 through 3-8 according to the present invention which contain at least the δ-$Bi_2O_3$ crystalline phase and the bismuth-containing amorphous phase and in which the content of bismuth in each of the phase satisfies (1) $0.10 \leqq B/A \leqq 0.40$, preferably $0.2 \leqq B/A \leqq 0.3$ and (2) $0.05 \leqq C/A \leqq 0.30$, preferably $0.10 \leqq C/A \leqq 0.2$ have better characteristic values and fewer variations thereof as compared with Comparative Example Nos. 3-1 through 3-8 which do not satisfy one or both of the above-mentioned requirements.

As is clear from the above explanation, according to the voltage non-linear resistor of the present invention, the intergranular phase of the sintered body is partially made amorphous, and the content of bismuth in the amorphous phase and the content of the bismuth in the $\delta$-$Bi_2O_3$ phase are controlled to respectively specified values. Thus, excellent electrical properties can be obtained together with excellent hygroscopicity without suffering variations in characteristics.

What is claimed is:

1. A voltage non-linear resistor comprising zinc oxide and at least one material selected from the group consisting of bismuth oxide, antimony oxide, and silicon oxide as additives, wherein crystalline phases of said bismuth oxide in said resistor include at least a $\beta$ type crystalline phase and a $\delta$ type crystalline phase, and $\beta$ and $\delta$ satisfy the following inequality:

$$60 \leqq \frac{\beta}{\beta + \delta} \times 100 \leqq 90$$

in which $\beta$ and $\delta$ are contents of the $\beta$ type crystalline phase and the $\delta$ type crystalline phase, respectively.

2. The resistor of claim 1, wherein said silicon oxide is amorphous.

3. The resistor of claim 1, further comprising $Co_3O_4$ as an additive.

4. The resistor of claim 1, wherein said resistor has the following composition:

0.1–2.0 mol% $Bi_2O_3$,
0.1–2.0 mol% $Co_3O_4$,
0.1–2.0 mol% $MnO_2$,
0.1–2.0 mol% $Sb_2O_3$, 0.1–2.0 mol% $Cr_2O_3$, 0.001–0.01 mol% $Al(NO_3)_3 \cdot 9H_2O$,
0.01–0.3 wt% bismuth borosilicate glass containing silver, 0.5–3.0 mol% amorphous $SiO_2$, and the balance being ZnO.

5. The resistor of claim 1, wherein said resistor exhibits a change rate of 3.8–6.2%.

6. The resistor of claim 1, wherein said resistor exhibits a $V_{1mA}$ change rate of 3.8–6.2%.

7. The resistor of claim 1, wherein said resistor exhibits an average $V_{1mA}$ reduction rate of 3.0–5.8%.

8. A voltage non-linear resistor comprising zinc oxide and at least one material selected from the group consisting of bismuth oxide, antimony oxide, and silicon oxide as additives, wherein crystalline phases of said bismuth oxide in said resistor include at least an $\alpha$ type crystalline phase, a $\beta$ type crystalline phase, and a $\delta$ type crystalline phase, and $\alpha$, $\beta$ and $\delta$ satisfy the following inequalities:

$$15 \leqq \frac{\alpha}{\alpha + \beta + \delta} \times 100 \leqq 50,$$

-continued $$25 \leqq \frac{\beta}{\alpha + \beta + \delta} \times 100 \leqq 60, \text{ and}$$

$$10 \leqq \frac{\delta}{\alpha + \beta + \delta} \times 100 \leqq 40,$$

in which $\alpha$, $\beta$ and $\delta$ are contents of the $\alpha$ type crystalline phase, the $\beta$ type crystalline phase, and the $\delta$ type crystalline phase, respectively.

9. The resistor of claim 8, wherein said silicon oxide is amorphous.

10. The resistor of claim 8, further comprising $Co_3O_4$ as an additive.

11. The resistor of claim 8, wherein said resistor has the following composition:

0.1–2.0 mol% $Bi_2O_3$,
0.1–2.0 mol% $Co_3O_4$,
0.1–2.0 mol% $MnO_2$,
0.1–2.0 mol% $Sb_2O_3$,
0.1–2.0 mol% $Cr_2O_3$,
0.1–2.0 mol% NiO,
0.001–0.01 mol% $Al(NO_3)_3 \cdot 9H_2O$,
0.01–0.3 wt% bismuth borosilicate glass containing silver, 1.0–3.0 mol% amorphous $SiO_2$, and the balance being ZnO.

12. The resistor of claim 8, wherein said resistor exhibits a $V_{1mA}$ change rate of 3.8–6.2%.

13. The resistor of claim 8, wherein said resistor exhibits a $V_{40kA}$ change rate of 2.0–3.8%,

14. The resistor of claim 8, wherein said resistor exhibits an average $V_{1mA}$ reduction rate of 3.0–5.8%.

15. A voltage non-linear resistor comprising zinc oxide and at least one material selected from the group consisting of bismuth oxide, antimony oxide, and silicon oxide as additives, wherein the resistor contains at least a $\delta$-$Bi_2O_3$ crystalline phase and an amorphous phase containing bismuth, and a content of bismuth in each of the phases satisfies the following inequalities:

$$0.10 \leqq B/A \leqq 0.40 \quad (1)$$

$$0.05 \leqq C/A \leqq 0.30 \quad (2)$$

in which A, B and C are the total content of bismuth in a sintered body of the resistor, the content of bismuth in the $\delta$-$Bi_2O_3$ type crystalline phase, and the content of bismuth in the bismuth-containing amorphous phase, respectively.

16. The resistor of claim 15, wherein said silicon oxide is amorphous.

17. The resistor of claim 15, further comprising $Co_3O_4$ as an additive.

18. The resistor of claim 15, wherein said resistor exhibits an average voltage non-linearity index of 31–70.

19. The resistor of claim 15, wherein said resistor exhibits a limit voltage ratio $V_{10kA}/V_{1mA}$ of 1.6–1.7.

20. The resistor of claim 15, wherein said resistor exhibits an average rate of leakage current of 0.29–0.69.

* * * * *

UNITED STATES PATENT AND TRADEMARK OFFICE

CERTIFICATE OF CORRECTION

PATENT NO. : 5,039,971

DATED : August 13, 1991

INVENTOR(S) : Osamu IMAI and Ritsu SATO

It is certified that error appears in the above-identified patent and that said Letters Patent is hereby corrected as shown below:

Column 13, claim 5, line 2, after "a" insert --$V_{1mA}$--.

Column 13, claim 6, line 2, change "$V_{1mA}$" to --$V_{40kA}$-- and change "3.8-6.2%" to --2.0-3.8%--.

Signed and Sealed this

Fourteenth Day of June, 1994

*Attest:*

*Attesting Officer*

BRUCE LEHMAN

*Commissioner of Patents and Trademarks*